United States Patent [19]

Gerdes

[11] Patent Number: 5,042,420

[45] Date of Patent: Aug. 27, 1991

[54] TRAPEZOIDAL PAINTING STRUCTURE

[75] Inventor: Donald F. Gerdes, Park Ridge, Ill.

[73] Assignee: Binks Manufacturing Company, Franklin Park, Ill.

[21] Appl. No.: 441,168

[22] Filed: Nov. 27, 1989

[51] Int. Cl.[5] ..... B05B 15/12

[52] U.S. Cl. ..... 118/50.1; 52/79.4; 55/DIG. 46; 98/115.2; 118/50; 118/64; 118/326; 118/DIG. 7

[58] Field of Search ..... 118/50, 64, 326, 641, 118/DIG. 7, 50.1; 55/DIG. 46; 98/115.2, 115.3; 52/794, 236.1

[56] References Cited

U.S. PATENT DOCUMENTS

| | | | |
|---|---|---|---|
| 2,559,249 | 7/1951 | Hudson | 52/64 |
| 3,308,740 | 3/1967 | Henson et al. | 98/115.2 |
| 3,564,785 | 2/1971 | Kephart, Jr. | 52/630 |
| 4,231,289 | 11/1980 | Domicent | 118/DIG. 7 |
| 4,621,187 | 11/1986 | Petro, Jr. | 98/115.2 |
| 4,700,615 | 10/1987 | Napadow | 55/DIG. 6 |

FOREIGN PATENT DOCUMENTS

| | | | |
|---|---|---|---|
| 75219 | 1/1919 | Austria | 52/64 |
| 309275 | 3/1989 | European Pat. Off. | 98/115.2 |

*Primary Examiner*—James C. Housel
*Attorney, Agent, or Firm*—Juettner Pyle & Lloyd

[57] ABSTRACT

A painting structure for use as, by way of example, a paint spray booth or paint baking or drying oven, utilizes a trapezoidal cross-section, instead of the conventional rectangular/square or rectangular-gabled cross-section. The painting structure of the present invention provides inherent rigidity without the need for special framing, and provides more uniform air flow than a gabled roof structure, as air swirls in air pockets beneath the gables are eliminated. Due to the simplified construction, the trapezoidal cross-sectional booth of the present invention is less expensive to make and install and more easily erected.

19 Claims, 3 Drawing Sheets

PRIOR ART

TRAPEZOIDAL PAINTING STRUCTURE

This invention relates to a painting structures, such as spray painting booths and/or paint drying ovens, and more particularly to the cross-sectional arrangement for such structures.

BRIEF DESCRIPTION OF THE PRIOR ART

Heretofore, painting structures, such as spray booths and/or paint drying ovens, have been built of a generally rectangular shape, with two opposite side walls generally parallel to each other. See FIG. 1. In some versions, the structures may have had inwardly and upwardly extending slanted portions, or gables, in the roof for accommodating light fixtures. See FIG. 2.

Examples of such prior art structures can be found in U.S. Pat. Nos. 4,096,066, 4,133,255, 4,173,924, 4,220,078, 4,222,319, 4,231,289, 4,241,646 and 4,292,056. These patents have complete side walls, or at least substantial portions thereof, which extended vertically or perpendicularly from the ground. As can be appreciated, the simple rectangular or square cross-sectional shape has the disadvantage of, if not heavily built, swaying or flexing, because a pair of parallel side walls set perpendicular to a parallel floor and roof lack inherent rigidity. To prevent such swaying or flexing, additional structural framing was necessary and provided. Of course, booths or ovens with gables in the roof are even more likely to sway or flex unless heavily built and/or strong structural framing is provided. Further, the gable construction necessitates additional, special panels forming the gables and reduces the number of standard size panels that are utilized to make the structure. Additionally, when the booth or oven is of a down draft construction, wherein air is supplied from the ceiling, the gables at the juncture of the roof and sides can create air spaces or pockets with air swirls therein which disrupt the generally desired downward air flow and/or can cause contaminants to collect on and/or blow onto the article being painted or upon which the paint is being baked or dried. Also, structures with gables on the roof are more expensive to build as they have more parts and more expensive to install because of the additional parts and extra work required to align the additional parts.

SUMMARY OF THE PRESENT INVENTION

To overcome the foregoing disadvantages, a painting booth or oven structure of the present invention is provided without gables and with a trapezoidal, instead of the customary square or rectangular, cross-section.

In the preferred form the trapezoidal booth or oven structure of the present invention comprises a pair of straight, but inclined side walls that are spaced closer together at their tops than bottoms and a parallel floor and roof which connect the bottoms and tops of the inclined side walls together. Further, the roof is preferably provided with a full width air plenum which forms the ceiling of the paint spraying or drying space below.

The use of a roof shorter than the floor and the slanted or inclined, straight side walls joining the roof to the floor, inherently gives greater strength and rigidity. The booth or oven structure of the present invention is made up of fewer parts than a gabled design, can be easily standardized, and eliminates the need for extra structural framing. The structure of the present invention is less costly to manufacture and less costly to install as there are few pieces to make and align. The heretofore, costly to construct, and structurally weakening gables are eliminated. Additionally, not only is construction and installation less expensive, but the trapezoidal cross sectional structure provides superior and more uniform downward air flow from its ceiling plenum then would a structure with gables.

It is a primary object of the painting structure of the present invention to provide a cross-sectional shape or arrangement which is rigid and strong without the need for special structure framing.

Another object of the painting structure of the present invention is to reduce the cost of construction and of installation.

A further object of the painting structure of the present invention is to provide improved air flow, eliminating air pockets and/or air swirl that exists in prior art gabled structures.

These and other object of the present invention will become apparent from the following written description and accompanying drawings.

BRIEF DESCRIPTION OF THE PREFERRED EMBODIMENT

Figure 2:
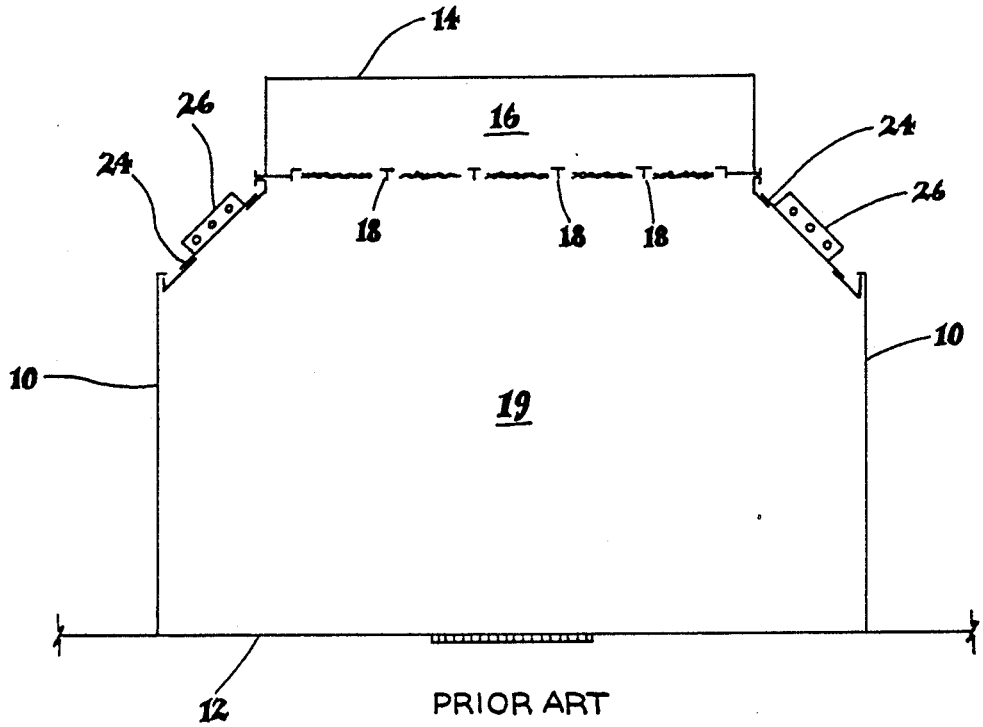
FIG. 2 is a cross-sectional view of a second prior art painting structure of a rectangular cross-section, but with gables.
Figure 1:
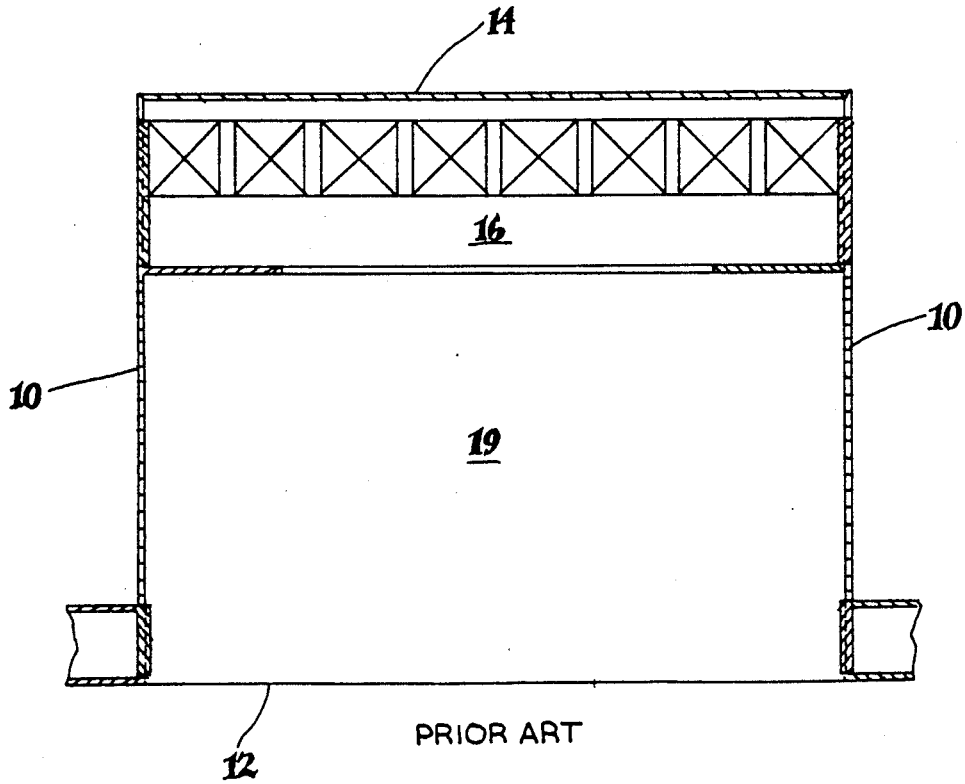
PRIOR ART Fig. 1
FIG. 1 is a cross-sectional view of one prior art painting structure of rectangular cross-section.

Referring to FIGS. 1 and 2, prior art booths of either a rectangular or rectangular and gabled construction are shown. The prior art structures of FIGS. 1 and 2 have side walls 10 rising vertically from the floor 12 and joined to a roof 14. The roof and upper portions of the side walls may form an internal plenum 16, with a ceiling 18 therebelow made of a foraminous material closing off the plenum from the work space 19 below. As shown in FIG. 2, in the gabled version, the roof 14 and side walls 10 are joined by gables 24, which in this instance carry fluorescent light fixtures 26. These prior art booths were, of course, somewhat unstable and usually required additional support or framing (not shown) to prevent them from swaying or flexing. Of course, the gable construction of FIG. 2 was more complicated than the construction of FIG. 1 and was more expensive to make and install because of the extra parts and the need to align them.

Figure 3:
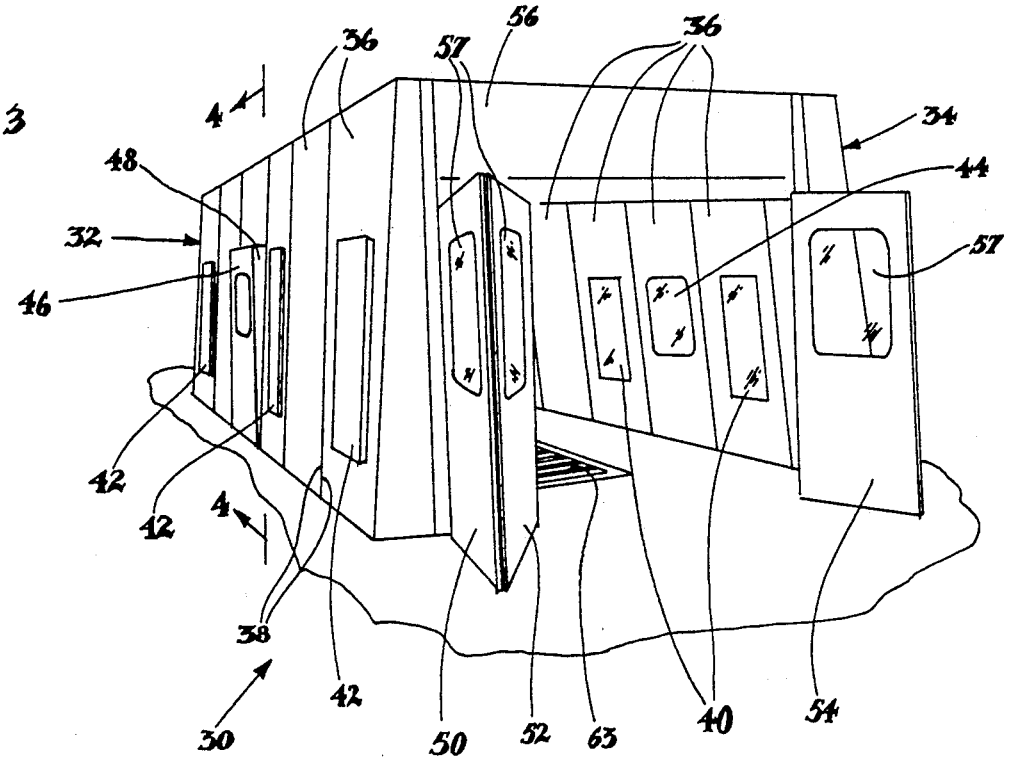
FIG. 3 is a perspective view of the trapezoidal cross-sectional painting structure of the present invention.

The painting structure of the present invention, which could be utilized as, for example, a spray booth or oven, has a trapezoidal cross-sectional shape, instead of the prior art rectangular or rectangular-gabled construction. For purposes of illustration, and not by way of limitation, a paint spray booth structure 30 is shown in FIG. 3. The booth 30 comprises a pair of inclined or slanted walls 32 and 34 which are made up of standard sized panels 36 say 132" long and 36" wide with the tops inclined toward each other at an angle 6° from vertical. While the angle of 6° is used, any angle within a range of 5° to 10° would be acceptable. The side edges 38 of adjacent panels 36 are joined to each other by any convention construction known in the spray booth and/or oven arts. The sides 32 and 34 are joined to a roof 31 (FIG. 4) and a floor 33 to enclose the booth's work space 35. To locate the bottom of the side walls 32 and 34, the panel's bottom edges are set into channels 37 (FIG. 4) secured to the floor. The booth 30 could be of any size, and is shown large enough to accommodate an automotive vehicle for painting.

If desired, one or more, and in this case alternate panels have been fitted with windows 40, behind which (outside of the booth) a suitable light fixture 42 is arranged and located to shine through the window 40 to provide illumination for painting. Of course, other arrangements of light fixtures could be provided, or windows provided without any light fixtures However, the advantage of providing the light fixture with its long dimension vertical, as compared to horizontal, is that the light and window can be provided in the center of panel 36 without rendering the panel ineffective to carry vertical loads. Thus, for this reason the lighting arrangement of FIG. 3 is preferred.

If it were desired, the side walls 32 and/or 34 could be fitted with infrared heaters, (59A in FIG. 4) set in the wall in a manner similar to the lights. However, if quartz heaters are used, they would preferably be horizontal, rather than vertical (similar to 59), to optimize heater life. Rather than putting the heater tube behind a window, it would be closed off from the work space by a movable door to protect the heater when it is not is use. When horizontal openings are provided in the panels for such heaters or lights, the vertical edges of the panels can be reinforced with an extra strip of thicker sheet metal to help carry the load.

Of course, other size windows 44 could be provided in other panels 36. Further, if desired, a personnel door 46 can be provided in other of the panels 36. For ease of use and to make for easy opening and closing, the door frame for door 46 is completely vertical, and the surrounding area between the door frame and inclined side wall 32 of the booth is enclosed as indicated at 48.

To assist in entry and removal of the article to be painted, large doors, such as the conventional three part doors 50, 52 and 54 are provided on one or more ends of the booth. Again, for ease of opening the end wall 56 closing the booth is vertical so that the doors 50, 52 and 54 are also hung vertically. As shown the doors may be provided with windows 57. As is shown door 50 is hinged and hung to one side of the booth, and door 52 hinged and hung off of door 50, door 54 being hinged and hung off the other side of the booth. The other end of the booth could be closed by a similar door arrangement, be left open, and/or closed by a vertical or somewhat inclined wall.

Figure 4:
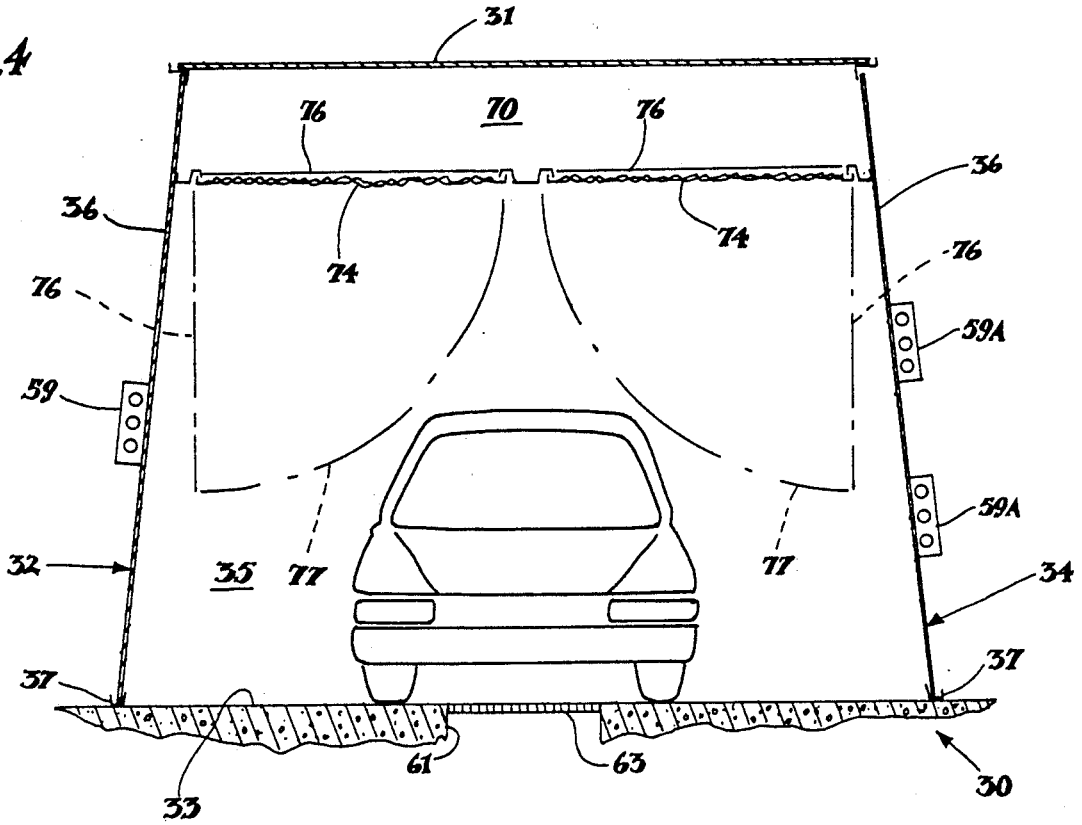
FIG. 4 is a cross-sectional view of the structure shown in FIG. 3 taken along the line 4—4, but showing some alternative lighting arrangements.

Referring to FIG. 4, a cross section of the booth of FIG. 3 is shown. However, for purposes of illustration, other alternative lighting or infrared quartz heating systems are shown. Instead of having lighting as described in FIG. 3, the booth in FIG. 4 shows fluorescent fixtures 59 arranged horizontally, one side of the booth having two such fixtures and the other having but one. It is, of course, understood that windows are provided in the walls through which the lights may shine. The other side of this booth is also provided with two rows of parallel quartz infrared heaters 59A.

As is apparent from FIGS. 3 and 4, the booth 30 is of the down draft type and is provided with a floor opening 61 covered by a grill 63 to permit the withdrawal of the paint laden air from the booth. Such an opening could also be used to recirculate air for reheating in a hot air type oven configuration.

Further, FIG. 4 illustrates that a plenum 70 is formed by the tops of the two inclined sides 32 and 34 and the roof 31. The plenum is closed off from the roof 31, by a ceiling 72, which is preferably made of a foraminous filter material or cloth 74. The filter material 74 is carried in rectangular frame members 76 that, in this instance, are carried across one half the width of the booth. The frames 76 are pivoted at one end, in this instance the outer end as shown, so as to swing down, as indicated in the dotted lines 77, to facilitate changing the filter material when such is needed. However, preferably, the filter frame member could be pivoted 90° from the position shown in FIG. 4 so that the pivot axis of the filter frame member is perpendicular to the booth's longitudinal axis, instead of parallel to that axis. To support the filter cloth, the frame member 76 is a rectangular frame having two side channels and two end channels, one of which is hinged from and the other is latchable in a horizontal position. Between the side channels a plurality of fixed battens or rods are provided, similar to the rungs on a ladder, to support the filter cloth in position. Instead of the filter frames being provided with spaced fix battens, the battens could be made removable and carried in pockets sewn or otherwise provided in the filter cloth material. A more complete description of such a filter cloth and batten arrangement is given in the copending George Allen, U.S. patent application No. 07/441,167, filed Nov. 27, 1989, entitled "Structure and Filter For Paint Spray Booth Or The Like" and filed on the same date as the present application.

Figure 5:
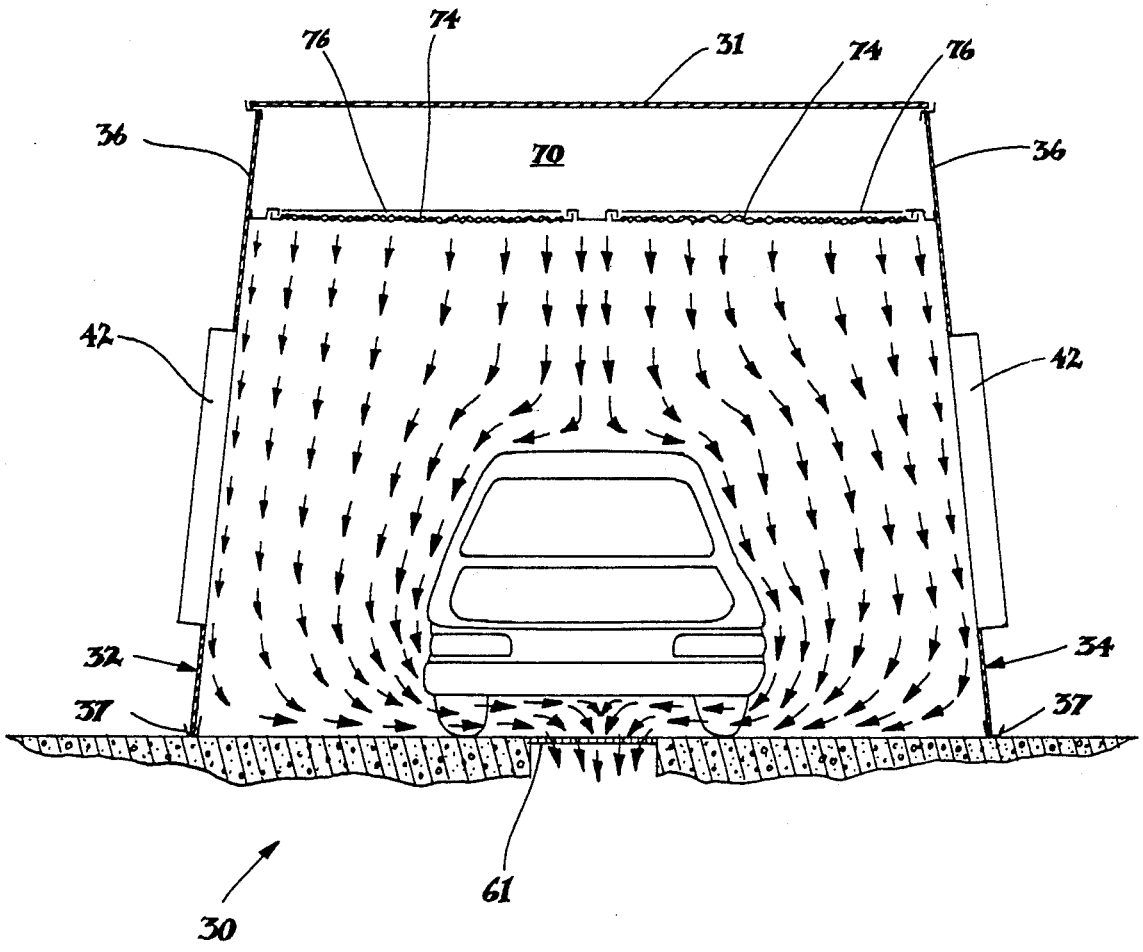
FIG. 5 is a cross-sectional view of the structure of FIG. 3 showing the air flow.

The typical air flow through the down draft type booth 30 of the present invention is illustrated in FIG. 5. The air flow is generally uniform downwardly from the plenum 70 and filter-cloth ceiling, around the article or vehicle being painted and into the grill floor 63. The air swirls that formed in air pockets beneath the gables of prior art gabled booths are absent, thus providing a more desirable, more uniform air flow in the work space 35 and about the article.

While painting structure of the present invention was described for a spray booth, this concept could also be utilized for a paint drying or baking oven where suitable heating means such as infrared lamps, an air heater, or other heating means could be provided. Further, while a job shop type booth was illustrated and described, the present invention could also be utilized to produce a production, tunnel type booth and/or oven. Further, while the walls of the booth shown were simple panels, they could also be of a more complicated construction, such as double wall, double wall with insulation, particularly for an oven, or of bent construction to provide additional rigidity, as is well known in the art. For example, the ends of the panels could be bent at an angle to the panels to provide stiffening flanges, and then the respective flanges joined together by various fastening means, adhesives, or sheet metal clips. While the booth 30 shown is of a down draft construction, other type booths such as side draft could also utilize the present invention. While the preferred embodiment of trapezoidal booth of the present invention has been illustrated and described, from the foregoing it should be understood that variations, modifications and equivalent structures therefor fall within the scope of the appended claims.

What is claimed is:

1. A painting structure for one of spraying paint and drying paint on an article, comprising a pair of straight, inclined side walls inclined toward each other from the bottoms to the tops of said side walls, a floor and a roof, said side walls, floor and roof forming a trapezoidal cross section, and an air flow system, including a ceiling and means for causing air flow from said ceiling for providing downward air flow over said article, said ceiling extending essentially the full width of said roof to the tops of said side walls, whereby said painting structure is inherently stable, air pockets beneath said ceiling are avoided, and the air flow from said ceiling is generally downward across the entire space between the tops of said side walls.

2. A painting structure as in claim 1, wherein said structure is a spray painting booth.

3. A painting structure as in claim 2, wherein said structure is also a paint baking oven.

4. A painting structure as in claim 1, wherein said structure is a paint baking oven.

5. A painting structure as in claim 1, wherein each of said inclined side walls is made of a plurality of straight rectangular panels joined together.

6. A painting structure as in claim 5, wherein at least one of said straight rectangular panels is provided wit a window, said window being situated in substantially the center of said one panel.

7. A painting structure as in claim 1, further comprising a door and door frame on one of said inclined side walls, said inclined side walls being rectangular, said door and door frame being vertical to facilitate opening and closing of said door, said door frame and said inclined rectangular side wall being joined together to close off the space between said one inclined rectangular side wall and said vertical door frame.

8. A painting structure as in claim 7, wherein each of said inclined rectangular side walls is formed by a plurality of panels, one of said panels mounting said door and door frame.

9. A painting structure for one of spraying paint and drying paint on an automotive vehicle, comprising a pair of straight, inclined side walls inclined toward each other from the bottoms to the tops of said side walls, a floor and a roof, said side walls, floor and roof forming a trapezoidal cross section, said side walls, floor and roof being of sufficient size to form a trapezoidal cross section structure capable of accommodating the automotive vehicle, and an air flow system, including a ceiling and means of causing air flow from said ceiling for providing air flow over the automotive vehicle, said ceiling extending essentially the full width of said roof to the tops of said side walls, whereby said painting structure is inherently stable, air pockets beneath said ceiling are avoided, and the air flow from said ceiling is generally downward across entire space between the tops of said side walls.

10. A painting structure for one of spraying paint and drying paint on an article, comprising a pair of straight, inclined side walls inclined toward each other from the bottoms to the tops of said side walls, a floor and a roof, said side walls, floor and roof forming a trapezoidal cross section, said inclined side walls supporting said roof over said floor, and an air flow system, including a ceiling and means for providing air flow from said ceiling for providing downward air flow over said article, said ceiling extending essentially the full width of said roof to the tops of said side walls, whereby said painting structure is inherently stable, air pockets beneath said ceiling are avoided, and the air flow from said ceiling is generally downwardly across the entire space between the tops of said side walls.

11. A painting structure for one of spraying paint and drying paint on an automotive vehicle, comprising a pair of straight, inclined side walls inclined toward each other from the bottoms to the tops of said side walls, a floor and a roof, said side walls, floor and roof forming a trapezoidal cross section, said side walls, floor and roof being of sufficient size to form said trapezoidal cross section capable of accommodating the automotive vehicle, said inclined side walls supporting said roof over said floor, floor channels secured to the ground to support the bottoms of said inclined side walls, said bottoms of said inclined side walls being received in said floor channels, and an air flow system, including a ceiling and means for providing air flow from said ceiling for providing downward air flow over the automotive vehicle, said ceiling extending essentially the full width of said roof to the tops of said side walls, whereby said painting structure is inherently stable, air pockets beneath said ceiling are avoided, and the air flow from said ceiling is generally downwardly across the entire space between the tops of said side walls.

12. A painting structure for one of spraying paint and drying paint on an article, comprising a pair of generally rectangular straight, inclined side walls inclined toward each other from the bottoms to the tops of said side walls, a floor and a roof, said inclined rectangular side walls being secured to said roof and floor, said inclined rectangular side walls, floor and roof forming a trapezoidal cross section, said structure being a spray painting booth, said spray painting booth being a down draft booth, said floor having an opening therein to accommodate withdrawing air from the trapezoidal cross-section, whereby said painting structure is inherently stable.

13. A painting structure as in claim 12, wherein said structure also is a paint baking oven.

14. A painting structure for drying paint on an article, comprising a pair of generally rectangular straight, inclined side walls inclined toward each other from the bottoms to the tops of said side walls, a floor and a roof, said inclined rectangular side walls being secured to said roof and floor, said inclined rectangular side walls, floor and roof forming a trapezoidal cross-section, said structure being a paint baking oven, said paint baking oven having down draft airflow, said floor having an opening therein to accommodate withdrawing air from the trapezoidal cross-section, whereby said painting structure is inherently stable.

15. A painting structure for one of spraying paint and drying on an article, comprising a pair of straight, inclined side walls inclined toward each other from the bottoms to the tops of said side walls, a floor and a roof, said side walls, floor and roof forming a trapezoidal cross section, said side walls being made of a plurality of straight panels joined together, at least one of said panels being provided with a window, said window being situated in substantially the center of said one panel, and a lighting fixture, said lighting fixture being mounted outside of said side wall and juxposed said window, whereby said painting structure is inherently stable, and light may shine into said structure through said window.

16. A painting structure for one of spraying paint and drying paint on an article, comprising a pair of straight, inclined side walls inclined toward each other from the bottoms to the tops of said side wall, a floor and a roof, said side walls, floor and roof forming a trapezoidal cross section, the tops of said side walls and said roof forming an upper air plenum for discharging. air into said structure, a ceiling closing the bottom of said plenum, filter frame means pivotally secured at one end to said ceiling, filter material being carried in said filter frame means, latch means at the other end of said filter frame means to secure said filter frame means horizontally on said ceiling, said filter frame means being pivotable between a first latched position with said filter frame parallel to said ceiling for filtering air coming from said plenum, and a second unlatched position with one end of said filter frame means pivoted downward below said ceiling for servicing said filter material, whereby said painting structure is inherently stable.

17. A painting structure for one of spraying paint and drying paint on an article, comprising a pair of straight, inclined side walls inclined toward each other at the tops of said side walls, a floor and a roof, said side walls, floor and roof forming a trapezoidal cross section, said side walls being made of a plurality of straight panels joined together, at least some of said panels being provided with openings therein to accommodate infrared heaters, and infrared heaters located in said openings whereby said painting structure in inherently stable.

18. A painting structure as in claim 17, further comprising elongated reinforcing strips, said reinforcing strips being secured vertically adjacent the edges of said panels having openings therein.

19. A painting structure as in claim 17, further comprising a door on the inside of said structure pivoted to each of said panels having openings therein to close off said openings and cover said infrared heaters when said infrared heaters are not being used.

* * * * *